US008443534B2

(12) United States Patent
Goodfellow et al.

(10) Patent No.: US 8,443,534 B2
(45) Date of Patent: May 21, 2013

(54) TWO-POSITION TAB

(75) Inventors: Andrew Goodfellow, Phoenix, AZ (US); Braden Jones, Phoenix, AZ (US); Brian Causse, Phoenix, AZ (US)

(73) Assignee: Esselte Corporation, Melville, NY (US)

( * ) Notice: Subject to any disclaimer, the term of this patent is extended or adjusted under 35 U.S.C. 154(b) by 478 days.

(21) Appl. No.: 13/068,839

(22) Filed: Jan. 20, 2010

(65) Prior Publication Data

US 2011/0215135 A1 Sep. 8, 2011

(51) Int. Cl.

| | |
|---|---|
| ***B42F 21/00*** | (2006.01) |
| ***B65D 27/00*** | (2006.01) |
| ***G09F 1/00*** | (2006.01) |
| ***A47G 1/06*** | (2006.01) |

(52) U.S. Cl.

USPC ..... 40/359; 40/641; 40/490; 40/649; 40/109; 40/374; 40/375; 40/488; 40/491; 40/611.06; 40/701; 40/765; 40/124.08; 40/445; 40/124.13; 40/124.06; 466/148; 466/149; 466/151; 229/67.1; 229/67.2; 116/327; 116/321; 281/45

(58) Field of Classification Search

USPC ..... 40/359, 641, 490, 649, 109, 374, 40/375, 488, 491, 611.06, 701, 765, 124.08, 40/445, 124.13, 124.06; 446/148, 149, 151; 229/67.1, 67.2; 116/327, 321; 281/45

See application file for complete search history.

(56) References Cited

U.S. PATENT DOCUMENTS

| | | | | |
|---|---|---|---|---|
| 626,901 | A | | 6/1899 | Gilman |
| 958,050 | A | | 5/1910 | Whipple |
| 1,688,965 | A | | 10/1928 | Helland |
| 1,697,985 | A | | 1/1929 | Lindsay |
| 1,711,895 | A | | 5/1929 | Lehman et al. |
| 2,260,407 | A | | 10/1941 | Schade |
| 2,300,623 | A | | 11/1942 | Hornung |
| 2,895,448 | A | * | 7/1959 | Haines ..... 116/324 |
| 3,132,628 | A | | 5/1964 | Gehlsen |
| 4,184,699 | A | | 1/1980 | Lowe, Jr. |
| 4,255,888 | A | | 3/1981 | Bastogne |
| 4,318,236 | A | | 3/1982 | Giulini |
| 4,905,393 | A | | 3/1990 | Laurie |

(Continued)

FOREIGN PATENT DOCUMENTS

| | | |
|---|---|---|
| GB | 2342320 | 4/2000 |
| JP | 3650829 | 5/2005 |
| KR | 10-2006-0109031 | 10/2006 |

OTHER PUBLICATIONS

International Search Report mailed on Aug. 31, 2011 for International Application No. PCT/US2011/021933.

(Continued)

*Primary Examiner* — Joanne Silbermann
*Assistant Examiner* — Syed A Islam
(74) *Attorney, Agent, or Firm* — Dorsey & Whitney LLP

(57) ABSTRACT

A tabbing apparatus is provided that includes a pocket and a tab element disposed within the pocket in a retracted position. The tab element includes an indexing segment configured for protruding from the pocket in an extended position as a tab and for being received within the pocket in the retracted position, an anchor portion attached to the pocket, and an intermediate portion connecting the anchor portion and indexing segment and configured for folding to allow the indexing segment to move between the retracted position and the extended position. The indexing segment is configured for displaying writing thereon for indexing a file.

23 Claims, 4 Drawing Sheets

U.S. PATENT DOCUMENTS

| | | | | |
|---|---|---|---|---|
| 4,967,951 | A * | 11/1990 | Sherman | 229/70 |
| 5,160,296 | A | 11/1992 | Katz | |
| 5,311,685 | A | 5/1994 | Wyant | |
| 5,341,982 | A | 8/1994 | Syers | |
| 5,540,513 | A | 7/1996 | Wyant | |
| 5,692,670 | A * | 12/1997 | Ho | 229/67.1 |
| 5,996,881 | A | 12/1999 | Smith | |
| 6,732,461 | B2 | 5/2004 | Slattery et al. | |
| 6,883,460 | B2 | 4/2005 | Weisenfeld | |
| 6,928,761 | B2 | 8/2005 | Frappell | |
| 6,976,449 | B2 | 12/2005 | Weisenfeld | |
| 7,025,382 | B2 | 4/2006 | Wiggins | |
| 7,040,051 | B2 | 5/2006 | Windorski | |
| 7,610,707 | B1 * | 11/2009 | Payne | 40/641 |
| 1,048,577 | A1 | 12/2009 | Pardoe, Jr. | |
| 7,628,426 | B1 | 12/2009 | Rowe et al. | |
| 2003/0074817 | A1 | 4/2003 | Saylor | |
| 2003/0126779 | A1 | 7/2003 | Sato et al. | |
| 2005/0257408 | A1 | 11/2005 | Black | |
| 2006/0000134 | A1 | 1/2006 | Windorski | |
| 2006/0242869 | A1 | 11/2006 | Bunger et al. | |
| 2007/0119082 | A1 | 5/2007 | GilChrist | |
| 2007/0234601 | A1 | 10/2007 | Yoo et al. | |
| 2009/0178320 | A1 | 7/2009 | Goodfellow | |

OTHER PUBLICATIONS

International Written Opinion mailed on Aug. 31, 2011 for International Application No. PCT/US2011/021933.

* cited by examiner

TWO-POSITION TAB

TECHNICAL FIELD

The present subject matter relates generally to tabbing system, such as for identification or informational purposes for files, and more specifically to a tabbing system with an indexing segment that has two positions.

BACKGROUND

It is common practice to provide tab members which extend from the edge of file folders, index dividers, hanging files, binders, etc., at selected positions so that the folder, divider, or binder can be easily identifiable or to provide information regarding the contents of such file. For example, separable tabbing members are often used for insertion into slots near the edges of hanging files.

Additionally, when a series of tabbed hanging files are desired, the user must make sure that the tabs are inserted so that they are staggered for easy viewing. This is made often less than convenient since the user needs a separate set of tab members and must correctly judge which slots in which to insert the tab member edges so that each tab is staggered when multiple hanging file folders are viewed. Another problem with this type of tab member is sometimes the tab member is dislodged from the folder slots and lost.

Labels on the tab members may require changing to reflect the changing contents of the file folder or to allow the folder to be reused for a different purpose. Changing labels requires the old label to be removed from the tab member (a difficult task in itself), which often necessitates removing the tab member from the folder before the new label can be inserted and the tab member reinstalled in the file folder. In addition to the inconvenience and inefficiency involved in changing the index information on a file folder, the prior art system also suffers from a tendency for the labels to fall out of the tab member and become lost.

Also, when a series of folders are desirable it is important that the user obtains folders in which the integral tab member is positioned differently. Otherwise, the series of folders will have the tabs obstructing the view of other tabs that follow.

U.S. Pat. No. 6,910,622, for example, provides a suspended file folder having a support bar along an upper portion thereof, having notches therein for engagement with an index tab. The tab is rotatable about the support bar. U.S. Pat. No. 6,332,285 provides an indexing tab that is movable along an upper portion of the folder. However, both of these indexing tabs may still be dislodged, and the problems with changing labels found in the prior art.

It is thus desirable for a tabbing system that allows tabs to be readily extended or retracted while remaining stably in either position.

SUMMARY

The present subject matter relates generally to a tabbing comprising a pocket, and a tab element disposed within the pocket in a retracted position and including an indexing segment configured for protruding from the pocket in an extended position as a tab and being received within the pocket in the retracted position, the indexing segment configured for displaying writing thereon for indexing a file, an anchor portion attached to the pocket, and an intermediate portion connecting the anchor portion and indexing segment and configured for folding to allow the indexing segment to move between the retracted position and the extended position.

The indexing segment, intermediate portion and anchor portion can be hingedly connected to each other for allowing the indexing segment to slide between the retracted position and the extended position. The indexing segment, intermediate portion and anchor portion can be hingedly connected to each other for allowing the indexing segment to slide substantially linearly between the retracted position and the extended position. The indexing segment, intermediate portion and anchor portion can be hingedly connected to each other for allowing the indexing segment to move between the retracted position and the extended position while substantially retaining an orientation.

The indexing segment can have a mid position disposed between the extended and retracted positions, the pocket comprising a resilient member associated with the tab element for biasing the indexing segment away from the mid position toward the extended or retracted position depending on which side of the mid position the indexing segment is positioned on. The resilient member can be associated with the tab element such that the indexing segment in the retracted and extended positions is stably at rest.

The intermediate portion can comprise one or more intermediate segments that are hingedly connected between the anchor portion and the indexing segment. The intermediate portion can comprise a plurality of intermediate segments hinged to each other for progressively retracting and extending the indexing segment.

The indexing segment can have a mid position disposed between the extended and retracted positions, the pocket comprising a resilient member associated with the tab element for biasing the indexing segment away from a mid position toward the extended or retracted position depending on which side of the mid position the indexing segment is positioned on. The resilient member can comprise a resilient wall of the pocket that is flexed by the indexing segment when the indexing segment is in the mid position.

The intermediate portion can be hingedly connected to the anchor portion and indexing segment for pivoting during movement of the indexing segment between the retracted, mid, and extended positions, wherein the pocket has a cross-section that is elongated in depth and has a width, and the intermediate portion is configured for biasing the resilient wall to increase the width of the pocket in the mid position compared to in the retracted and extended positions of the indexing segment. The intermediate portion can extend at least partially widthwise with respect to the pocket in the mid position for biasing the resilient wall to increase the pocket width. The pocket can be disposed at an edge of a file for indexing the file.

The tabbing apparatus can further comprising an adhesive on the pocket configured and disposed for attachment to a file. The pocket can be made of a plastic film and defines a slit along a top portion for allowing the indexing segment to substantially linearly slide into and out of the pocket between the retracted and extended positions. The indexing segment can be wider than the slit for locking the indexing segment in the extended position. The tab element can comprise a plurality of tab elements such that selected ones of the indexing segments can be positioned in the extended and retracted positions for selectively indexing a file.

The tabbing apparatus can further comprise a file having a first panel having an edge and being configured and dimensioned for holding papers, wherein the pocket is provided on the first panel near the edge such that the indexing segment protrudes beyond the edge in the extended position. The file can comprise a second panel having an edge and being hinged with respect to the first panel for holding papers therebetween, wherein the indexing segment extends beyond the edge of the second panel in the extended position. The file can be folded to provide the first and second panels.

Also provided is a tabbing apparatus comprising a pocket and a tab element having an indexing segment configured for protruding from the pocket in an extended position as a tab, being received within the pocket in the retracted position, and having a mid position between the retracted and extended positions, wherein the indexing segment is configured for displaying writing thereon for indexing a file, wherein the pocket comprises a resilient member associated with the tab element for biasing the indexing segment away from the mid position toward the extended or retracted position depending on which side of the mid position the indexing segment is positioned on.

The tabbing apparatus can further comprise a file, comprising a first panel having an edge and being configured and dimensioned for holding papers, wherein the pocket is provided on the first panel near the edge such that the indexing segment protrudes beyond the edge in the extended position.

Additional advantages and novel features of the examples will be set forth in part in the description which follows, and in part will become apparent to those skilled in the art upon examination of the following description and the accompanying drawings or may be learned by production or operation of the examples. The advantages of the concepts may be realized and attained by means of the methodologies, instrumentalities and combinations particularly pointed out in the appended claims.

BRIEF DESCRIPTION OF DRAWINGS

The drawing figures depict one or more implementations in accord with the present concepts, by way of example only, not by way of limitations. In the figures, like reference numerals refer to the same or similar elements.

DETAILED DESCRIPTION OF PREFERRED EMBODIMENTS

Figure 1:
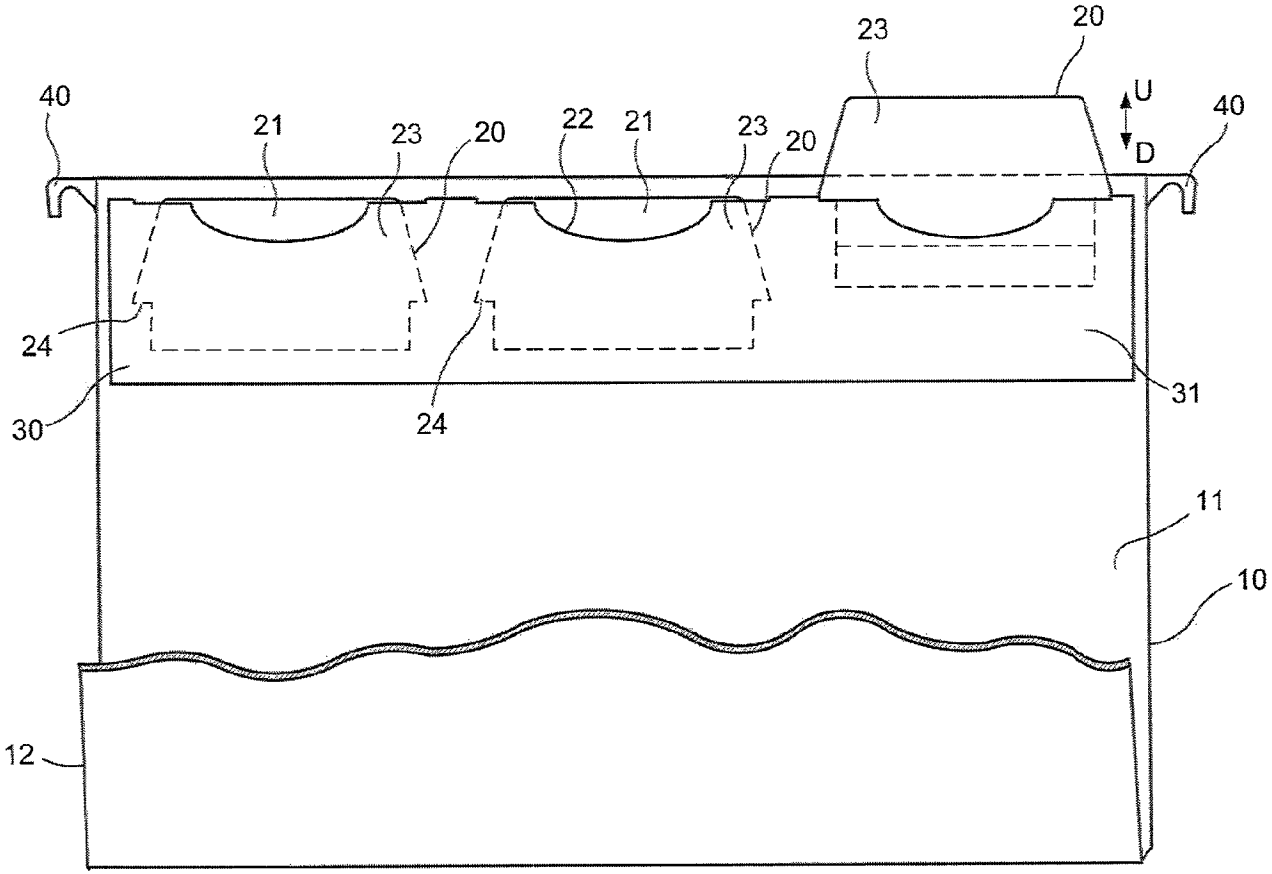
FIG. 1 is a front view of an embodiment of slidable tabs provided on a hanging file.

Referring to FIG. 1, a hanging file folder 10 with slidable tabs elements 20 housed in pocket 30, that can be made of any suitable material. In a preferred embodiment, it is made of a plastic film, but can alternatively be made of kraft paper, paperboard, or other suitable material, and can also be made of the same material as the file with which it is associated. The pocket 30 and slidable tabs 20 can be a part of or attached to a structure such as a file folder, a shelf folder, a hanging file folder, an expandable folder, a divider, a notebook or a binder, but is shown provided on a hanging file folder 10 in the embodiment of FIG. 1. The hanging file folder 10 can have a first cover panel 11 and a second cover panel 12, and hook members 40 or other such structure for hanging the file folder 10. The preferred hook members are provided on bars that extend across the top of the two folder panels, and have a recess configured for receiving and hanging from shelf rails, as known in the art. The file folder can be unitary such that it is folded to provide the first cover panel 11 and second cover panel 12.

In a preferred embodiment, the pocket 30 and slidable tabs 20 therein are connected to and a part of the hanging file folder 10. In another embodiment, the pocket 30 and slidable tabs 20 therein can be attached to an inner wall of the first cover panel 11 of the hanging file folder 10 as shown in FIG. 1. The pocket 30 and slidable tabs 20 therein can be attached to the inner wall of the first cover panel 11 by use of an adhesive or alternatively, a pressure sensitive adhesive strip (not shown) applied to the back side of the pocket 30 so that it may be adhered to a top edge of the file folder 10, as shown in FIG. 1.

The pocket 30 can be cut from a sheet of lightweight plastic, such as a thermoplastic material, and preferably polypropylene material or PVC. Other plastic materials may be used as would be known by one skilled in the art. The width of the plastic film is preferably about 2.5 inches, however, depending on the object to be tabbed the width of the plastic film may be larger or smaller. For example, the width desirable for use with index cards would be smaller than that desirable for use with notebooks or hanging files.

Three slidable tabs 20 are shown through a clear front wall 31 of the pocket 30 in the embodiment of FIG. 1, but as would be understood by one of ordinary skill in the art, one or more slidable tabs 20 can be provided in the pocket 30, as would be necessary or appropriate for the structure to be indexed. A top portion of the pocket 30 has slits 21 for the tabs 20 to be pulled upward in a direction U and out of the pocket 30. The slidable tabs 20 can also be pushed back down in a direction D into the pocket 30. As shown in FIG. 1, the two left slidable tabs 20 are contained within the pocket 30, and the slidable tab 20 on the right side is pulled out of the pocket 30, so that an indexing segment 23 is viewable by a user. Informational inserts (not shown) can be provided in the indexing segment 23 as known to one of ordinary skill in the art.

Cutout portions 22 are provided on the pocket 30 so that a user can grasp an indexing segment 23 of the slidable tabs 20 and pull or extend them upward in a direction U when they are within the pocket 30. An interlocking means 24 can be provided on the slidable tabs 20 such that when they are extended upward (as shown on the rightmost slidable tab 20 in FIG. 1), the overextended edges 24 just reach over the slit portion 21 and rest on the pocket 30. The overextended edges 24 provide an interlocking means with the top of the pocket 30, and the overextended edges 24 extend just enough to hold the slidable tabs 20 in place over the pocket 30, but if a little force is applied in the downward direction D, the slidable tab 20 is easily pushed back inside the pocket 30.

Figure 2:
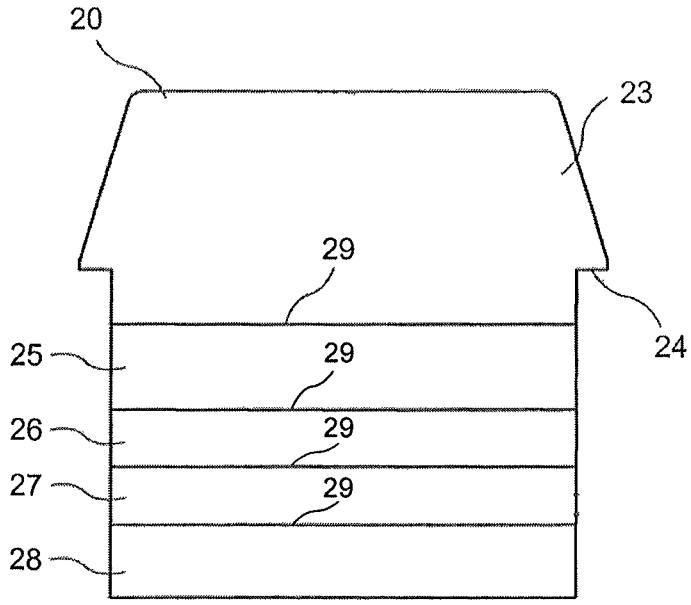
FIG. 2 is a front view of an embodiment of a slidable tab.

In FIG. 2, an embodiment of a slidable tab 20 is shown. The slidable tab 20 is preferably segmented, so that indexing segment 23, an intermediate portion, for example including intermediate segments 25, 26, 27, and anchor portion 28 are provided on the slidable tab 20. Hinges 29, such as living hinges provided at folds, allow the slidable tab to bend along the hinges 29 of the intermediate segments 25, 26, 27. More or less intermediate segments can be provided depending on the size of the slidable tab required, and one of ordinary skill in the art would understand how many intermediate segments to provide based on the particular application needed.

FIGS. 3(*a*)-3(*d*) illustrate a method of pulling the slidable tab 20 out of the pocket 30. In FIG. 3(*a*), when the indexing segment is in a retracted position, the slidable tab 20 is enclosed within the pocket 30, having a front wall 31 and a back wall 32, and a width W. The intermediate segments 25, 26, 27 are bent at the folds 29 so that the slidable tab 20 can be enclosed within the front wall 31 and back wall 32 of the pocket 30. Preferably, anchor portion 28 is secured against the inner wall 32 by an adhesive or some other means as would be known to one of ordinary skill in the art.

In FIG. 3(*b*), when a user lifts up the slidable tab 20 from the indexing segment 23 (through the cutout portion 22 as explained above) in a direction U, the slidable tab 20 linearly moves up from the pocket 30 through the slit 21. Because the anchor portion 28 does not move, the indexing segment 23 and intermediate segments 25, 26, 27 push against the outer wall 31 of the slidable tab 20, causing the walls 31, 32 to expand, thus having a greater width W.

In FIG. 3(*c*), the indexing segment 23 and intermediate segments 25, 26, 27 cause the walls 31, 32 to expand even more to a width W as the user lifts up the slidable tab 20 in the upwards direction U. Because the walls 31, 32 are under tension when they expand and are resilient when they are expanded, they assist in pushing the slidable tab 20 up in the direction U to return to their contracted state.

In FIG. 3(*d*), when the indexing segment 23 is in an extended position, the indexing segment 23 is substantially out of the pocket 30, and the walls 31, 32 are back to their regular contracted position and a width W. To return the sliding tab 20 into the pocket 30, the user simply pushes the indexing segment 23 downwards in a direction opposite U, and the process will take place backwards (FIG. 3(*d*)-FIG. 3(*a*)). As seen in FIG. 3(*c*), the width W of the pocket 30 increases compared to the retracted position (FIG. 3(*a*)) and extended position (FIG. 3(*d*)). As shown in the drawings, the anchor portion or segment 28 remains affixed to the pocket 30, such as the plastic film, throughout the movement between the retracted and extended positions and at those positions as well, with the intermediate portion The walls 31, 32 comprise a resilient member, such that when the indexing segment 23 is in a mid position (FIG. 3(*c*)) between the extended position and retracted position, the walls bias the indexing segment 23 away from a mid position toward the extended or retracted position depending on which side of the mid position the indexing segment 23 is on. For example, if the indexing segment 23 is further on the side of the extended position, the walls 32 will bias the indexing segment 23 toward the extended position. If the indexing segment 23 is further on the side of the retracted position, the walls 32 will bias the indexing segment 23 toward the retracted position.

Figure 3D:
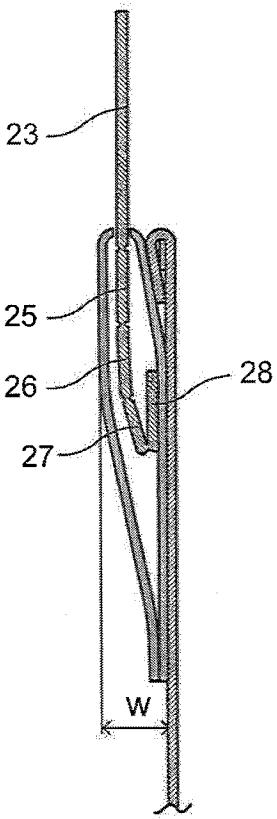
FIGS. 3(*a*)-3(*d*) are side views of an embodiment of a slidable tab being lifted up out or a retaining spring member.
Figure 3C:
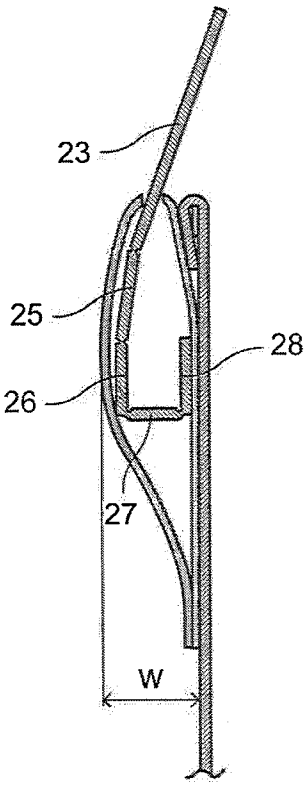
Figure 3B:
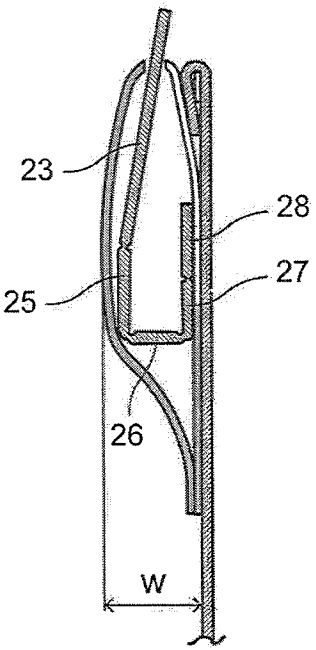
Figure 3A:
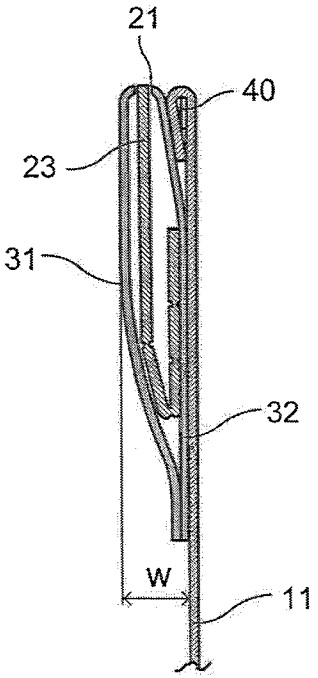

The intermediate segments 25, 26, 27 fold over themselves when the indexing segment 23 moves between the extended and retracted positions. An alternative intermediate portion can have a different structure capable of folding over itself, such as a band of flexible material. The hinges between the intermediate segments are preferably living hinges. The hinge 29 of the slidable tab 20 retains a U-shape between the index segment and the anchor portion 28 during the movement between the retracted and extracted position, as shown in FIGS. 3*a*-3*d*. The hinges 29 progressively closes and opens such that a portion of the slidable tab 20 progressively folds and unfolds from each other when the indexing segment 23 is moved from the retracted and extracted position. For example, the hinge 29 at the bottom of the U-shape in FIG. 3*a* that is, closed, is then opened in FIG. 3*d*, and one of the hinges 29 that is open in FIG. 3*a* is then closed and at the bottom of the U-shape in 3*d*. The indexing segment 23 substantially maintains its orientation while moving between the extended and retracted positions, such that it can slide without rotating about an axis parallel to the slit 21. Preferably, the indexing segment 23 can slide without rotating about the axis parallel to the slit less than 45 degrees, and more preferably 20 degrees, and even more preferably 10 degrees. The indexing segment 23 points out of the pocket 30 throughout the movement between the extended and retracted positions.

The indexing segment 23 preferably has an information insert, so that a user can view the information insert on the sliding tab 20. Having more than one slidable tab 20 on a folder allows different information inserts to be provided on one folder, if required.

Figure 4:
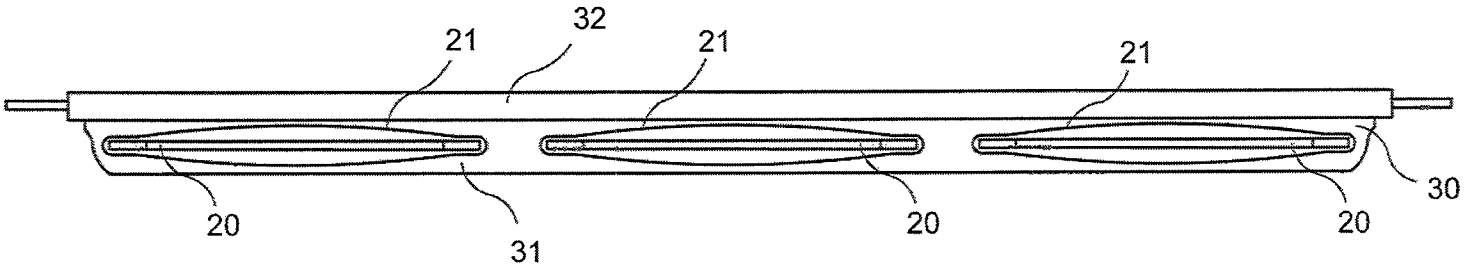
FIG. 4 is a top view of the slidable tabs.

FIG. 4 provides a top view of the pocket 30 and enclosed slidable tabs 20. In the embodiment shown, 3 slidable tabs 20 are provided within the pocket 30. The slidable tabs 20 can be lifted up through the slits 21, and the bendable walls 31, 32 of the pocket 30 allow the walls 31, 32 to expand and contract as the segmented slidable tabs 20 are lifted up and inserted back into the pocket 30.

The preferred tab system can be used to tab or index structures such as files, such as file folders, shelf folders, hanging files, expandable folders, dividers, books, notebooks, or binders. In one embodiment, the index tab system is provided as an integral assembly that is attached to the file or other structure, which in the preferred embodiment is a hanging file, such as by an adhesive. For example, the plastic film may be provided with a pressure sensitive adhesive strip applied to one side of the plastic film so that it may be adhered to the edge of a structure to be indexed or tabbed.

The preferred material for the plastic film is any thermoplastic material. Especially preferred from a cost and performance standpoint are polypropylene and PVC. However, as any skilled person in the art would know, any other resilient thermoplastic film may be used. The plastic film is preferably heat sealed in locations to attach the walls 31, 32 of the pocket 30 and to attach the anchor portion 28 thereto. Other methods known in the art can also be used to attach the walls of the pocket 30 and anchor portion 28 thereto. The width and length of the plastic film may vary depending upon whether the object to be tabbed is a hanging file, other folder, notebook, or index card. However, the preferable length of each tab element is approximately 2.0625" when 5 tabs are provided and approximately 3.5" when 3 tabs are provided. Of course, if the tabbing of index cards is desirable a smaller length is desirable.

Color coding of the slidable tabs or even the inserts can be used for the most efficient organization of file materials. The plastic film and/or slidable tabs may be colored and substantially transparent. The slidable tabs may be of different color than the object to be indexed. The informational inserts for the slidable tabs may be of a different color, or even some of the slidable tabs may be of different colors. The indexing segment 23 can have a writable surface configured and dimensioned for writing thereon, or can provide a label pocket for receiving and informational insert or label therein.

The slidable tabs may be of any shape or size, including shapes such as hearts, diamonds, animals, balloons, or other shapes that are appealable especially to children. These shapes can be achieved utilizing conventional die cutters.

The slidable tab structure is preferably rectangular shaped. However, as those skilled in the art will appreciate, the slidable tabs can be cut in a variety of shapes and sizes. For example, to appeal to children, the slidable tabs can be formed in the shape of animals, or flowers, for instance. Additionally, the slidable tab structure may be sized and shaped to receive a business logo for marketing purposes.

In use, a plastic film pocket with integral slidable tab structures can be attached to the edge of an object to be tabbed. By way of example and without intending to be limiting, the pocket with integral slidable tab structures is affixed to the edge of a hanging file by application of hot melt adhesive. An informational insert may be slid into the cavity or internal space of the indexing segment of the slidable tabs. More than one slidable tab may be provided, as necessary, on the pocket, depending on the requirement of the object to be tabbed. Also, various sizes of the slidable tabs may be provided.

All of the references specifically identified in the detailed description section of the present application are expressly incorporated herein in their entirety by reference thereto. The term "about," as used herein, should generally be understood to refer to both the corresponding number and a range of numbers. Moreover, all numerical ranges herein should be understood to include each whole integer within the range.

While illustrative embodiments of the invention are disclosed herein, it will be appreciated that numerous modifications and other embodiments may be devised by those skilled in the art. For example, the features for the various embodiments can be used in other embodiments. Therefore, it will be understood that the appended claims are intended to cover all such modifications and embodiments that come within the spirit and scope of the present invention.

What is claimed is:

1. A tabbing apparatus, comprising:

a pocket; and a tab element disposed within the pocket in a retracted position and including:

an indexing segment protruding from the pocket in an extended position as a tab and being received within the pocket in the retracted position, the indexing segment configured for displaying writing thereon for indexing a file, an anchor portion, and an intermediate portion pivotably connecting the anchor portion and indexing segment;

wherein the anchor portion is anchored to pocket so that, the intermediate portion pivots during the movement of the index segment between the retracted and extended positions.

2. The tabbing apparatus of claim 1, wherein the indexing segment, intermediate portion and anchor portion are hingedly connected to each other for allowing the indexing segment to slide between the retracted position and the extended position.

3. The tabbing apparatus of claim 2, wherein the indexing segment, intermediate portion and anchor portion are hingedly connected to each other for allowing the indexing segment to slide substantially linearly between the retracted position and the extended position.

4. The tabbing apparatus of claim 1, wherein the indexing segment, intermediate portion and anchor portion are hingedly connected to each other for allowing the indexing segment to move between the retracted position and the extended position while substantially retaining an orientation.

5. The tabbing apparatus of claim 1, wherein the tab element has a mid position in which the indexing segment is disposed between the extended and retracted positions, the pocket comprising a resilient member associated with the tab element the biasing the indexing segment away from the mid position toward the extended or retracted position depending on which side of the mid position the indexing segment is positioned.

6. The tabbing apparatus of claim 5, wherein the resilient member is associated with the tab element such that the indexing segment in the retracted and extended positions is stably at rest.

7. The tabbing apparatus of claim 1, wherein the intermediate portion comprises a plurality of intermediate segments connected by hinges between the anchor portion and the indexing segment so that the hinges are pivoted progressively along the intermediate portion during the movement between the retracted and extracted positions.

8. The tabbing apparatus of claim 5, wherein the resilient member comprises a resilient wall of the pocket that is flexed by the intermediate portion in the mid position.

9. The tabbing apparatus of claim 8, wherein the intermediate portion is hingedly connected to the anchor portion and indexing segment for pivoting during movement of the indexing segment between the retracted, mid, and extended positions, wherein the pocket has a cross-section that is elongated in depth and has a width, and the intermediate portion biases the resilient wall to increase the width of the pocket in the mid position compared to in the retracted and extended positions of the indexing segment.

10. The tabbing apparatus of claim 9, wherein the intermediate portion extends at least partially widthwise with respect to the pocket in the mid position for biasing the resilient wall to increase the pocket width.

11. The tabbing apparatus of claim 1, wherein the pocket is disposed at an edge of a file for indexing the file.

12. A file, comprising:

a first panel having an edge and being configured and dimensioned for holding papers; and the tabbing apparatus of claim 1, wherein the pocket is provided on the first panel near the edge such that the indexing segment protrudes beyond the edge in the extended position.

13. The file of claim 12, wherein the file comprises a second panel having an edge and being hinged with respect to the first panel for holding papers therebetween, wherein the indexing segment extends beyond the edge of the second panel in the extended position.

14. The file of claim 12, wherein the file is folded to provide the first and second panels.

15. The tabbing apparatus of claim 1, further comprising an adhesive on the pocket configured and disposed for attachment to a file.

16. The tabbing apparatus of claim 1, wherein the pocket defines a slit along a top portion for allowing the indexing segment to substantially linearly slide into and out of the pocket between the retracted and extended positions.

17. The tabbing apparatus of claim 16, wherein the indexing segment is wider than the slit for locking the indexing segment in the extended position.

18. The tabbing apparatus of claim 1, wherein the tab element comprises a plurality of tab elements such that selected ones of the indexing segments can be positioned in the extended and retracted positions for selectively indexing a file.

19. The tabbing apparatus of claim 1, wherein the anchor portion is affixed to a wall of the pocket.

20. The tabbing apparatus of claim 7, wherein:

the tab element has a mid position in which the indexing segment is disposed between the extended and retracted positions, the pocket comprising a resilient member associated with the tab element for biasing the indexing segment away from a mid position toward the extended or retracted position depending on which side of the mid position the indexing segment is positioned;

one of the intermediate segments is hingedly connected to the anchor portion and indexing, segment for pivoting during movement of the indexing segment between the retracted, mid, and extended positions, wherein the pocket has a cross-section that is elongated in depth and has a width, and said one of the intermediate segments biases the resilient member to increase the width of the pocket in the mid position compared to in the retracted and extended positions of the indexing segment; and the resilient member comprises a resilient wall of the pocket that is flexed by the intermediate segments in the mid position.

21. A tabbing apparatus, comprising:

a pocket; and a tab element having an indexing segment configured for protruding from the pocket in an extended position as a tab, being received within the pocket in the retracted position, and having a mid position between the retracted and extended positions, wherein the indexing segment is configured for displaying writing thereon for indexing a file;

wherein the pocket comprises a resilient member associated with the tab element for biasing the indexing segment away from the mid position toward the extended or retracted position depending on which side of the mid position the indexing segment is positioned on.

22. A file, comprising:

a first panel having an edge and being configured and dimensioned for holding papers; and the tabbing apparatus of claim 21, wherein the pocket is provided on the first panel near the edge such that the indexing segment protrudes beyond the edge in the extended position.

23. The tabbing apparatus of 21, wherein the tab element in the retracted, mid, and extended position has a substantially U-shape from the indexing segment to the anchor portion when viewed from a lateral cross-section, one of the hinges being at a bottom of the U-shape in each of the said positions.

* * * * *